United States Patent [19]

Kinoshita et al.

[11] Patent Number: 4,727,681

[45] Date of Patent: Mar. 1, 1988

[54] METHOD AND APPARATUS FOR SECURING WIRES STRETCHINGLY TO A WIRE DRIVING TYPE WINDOW REGULATOR

[75] Inventors: Tomotaka Kinoshita; Masatoshi Matsui, both of Yokohama, Japan

[73] Assignee: Ohi Seisakusho Co., Ltd., Japan

[21] Appl. No.: 926,431

[22] Filed: Nov. 3, 1986

[30] Foreign Application Priority Data

Nov. 7, 1985 [JP] Japan ..... 60-248078

[51] Int. Cl.[4] ..... E05F 11/48; B21D 39/00

[52] U.S. Cl. ..... 49/352; 29/434; 29/446; 29/452; 29/509; 29/283.5; 29/437; 29/513; 49/506

[58] Field of Search ..... 29/509, 446, 437, 452, 29/283.5, 434, 436; 49/352, 506

[56] References Cited

U.S. PATENT DOCUMENTS

| | | | |
|---|---|---|---|
| 3,073,009 | 1/1963 | Fenton et al. | 29/446 UX |
| 3,444,649 | 5/1969 | Revolier | 49/352 |
| 3,890,743 | 6/1975 | Eckhardt et al. | 49/352 |
| 3,965,564 | 6/1976 | Slovensky, Jr. | 29/434 |
| 4,090,329 | 5/1978 | Rampel | 49/352 |
| 4,199,899 | 4/1980 | Muhling et al. | 49/352 |
| 4,201,014 | 5/1980 | Hess | 49/352 X |
| 4,254,584 | 3/1981 | Hess | 49/352 X |
| 4,468,887 | 9/1984 | Koch | 49/352 |
| 4,637,166 | 1/1987 | Ujihara | 49/352 |

*Primary Examiner*—Charlie T. Moon

*Attorney, Agent, or Firm*—Poms, Smith, Lande & Rose

[57] ABSTRACT

Method for securing a wire in its tensioned condition in a wire driving type window regulator comprising a carrier plate to which a window glass is secured mounted on a pair of guide rails, a raising and a lowering wires each one end of which is secured to the carrier plate and each intermediate portion of which is inserted into an outer tube, said wires being moved up and down directions along a reciprocal passage running partially along the guide rails by a driving means, is carried out by boring a guide hole on either of supporting plates which support the guide rails into which a tube end plug is slidably inserted, and after then the tube end plug is pressed in the tensioned direction of the wire, and an edge of an opening of the guide hole being cut to make a cut piece which is erected so as to maintain the tensioned condition of the wire.

4 Claims, 7 Drawing Figures

METHOD AND APPARATUS FOR SECURING WIRES STRETCHINGLY TO A WIRE DRIVING TYPE WINDOW REGULATOR

BACKGROUND OF THE INVENTION

The present invention relates to a method and an apparatus for securing wires stretchingly for preventing the wires from their initial loosened conditions in a wire driving type window regulator in which window glasses of doors or the like of an automobile are adapted to move up and down by using wires.

PRIOR ART

The window regulator of the afore-mentioned wire driving type has a constructon, for example, as shown in FIG. 5, in which a window glass (c) is secured to a carrier plate (b) which is mounted on a guide rail (a) so that it may perform up and down movements along the guide rail (a), and a raising wire (d) and a lowering wire (e) each terminal of which is secured to the carrier plate (b) are linked to a driving means (f).

By reciprocally moving the wires (d) and (e) along a circular passage (g) which runs in parallel to the guide rail (a) with the afore-mentioned driving means (f), the carrier plate (b) and the window glass (c) are raised and lowered. A wire tensioning means in the window regulator of this type comprises a compressing coil spring (l) compressedly mounted between each of end members (j) secured to terminal ends of basic end sides of outer tubes (h) and (i) of the raising wire (d) and the lowering wires (e) and a bracket (k) of the driving means (f). By means of energizing force of the compressing coil spring (l) the wires (d) and (e) are adapted to be tensioned.

In the Japanese Patent Publication No. 46-3001 there is disclosure regarding a wire tensioning means similar to that of the above described. The tensioning means of the wire in this window regulator is shown in FIG. 6. That is, on each of terminal surfaces of mutual joining portions of outer tubes (n) and (o) into which a wire (m) is penetrated, a portion (p) having enlarged diameter is provided, and by energizing force of A compressing coil spring (q) accomodated in the portion having the enlarged diameter the wire (m) is tensioned.

In any of the above described conventional wire tensioning means energizing force of the compressing coil spring is utilized, so that in usual operating time of the window regulator too much load is put on each of the wires to stretch out these respective compressing coil springs, which results in changing substantial lengths of the outer tubes. Because of the afore-mentioned change in substantial lengths of the outer tubes, thus, in the conventional wire tensioning means there is such a disadvantage that movement of the carrier plate comes to get out of order and up and down movements of the window glass(es) are not carried out smoothly.

In view of the afore-mentioned disadvantage of the conventional wire tensioning means, the present invention is proposed to overcome the above described disadvantage of the conventional means.

SUMMARY OF THE INVENTION

It is a main object of the present invention to provide a method for securing wires stretchingly to a wire driving type window regulator in which wires are secured in their tensioned or stretched conditions to a window regulator so that the wires may be prevented from the initial loosened condition.

According to the present invention, in a wire driving type window regulator in which each of terminal ends of raising and lowering wires is secured to a carrier plate which is mounted on a guide rail so as to be able to move up and down along the guide rail and to which a window glass(es) is secured, each of intermediate portions of them is inserted into respective outer tubes, and said wires are reciprocally moved along circulating passages by a driving means so that the carrier plate and the window glass(es) are raised and lowered, in the case of the wires being stretchingly secured thereto, supporting plates each having a guide hole are provided between guide rails, tube end plugs provided at terminal ends of the both outer tubes are slidably inserted into said hole, and after pressing said tube end plugs in the stretching direction of the wires, an edge portion of each of said guide holes is erected by which each of the wires is being maintained in its stretched condition, respectively.

The main and other objects, features, advantages and uses will become more apparent proceeds, when considered with the accompanying drawings.

DESCRIPTION OF THE PREFERRED EMBODIMENT

Figure 1:
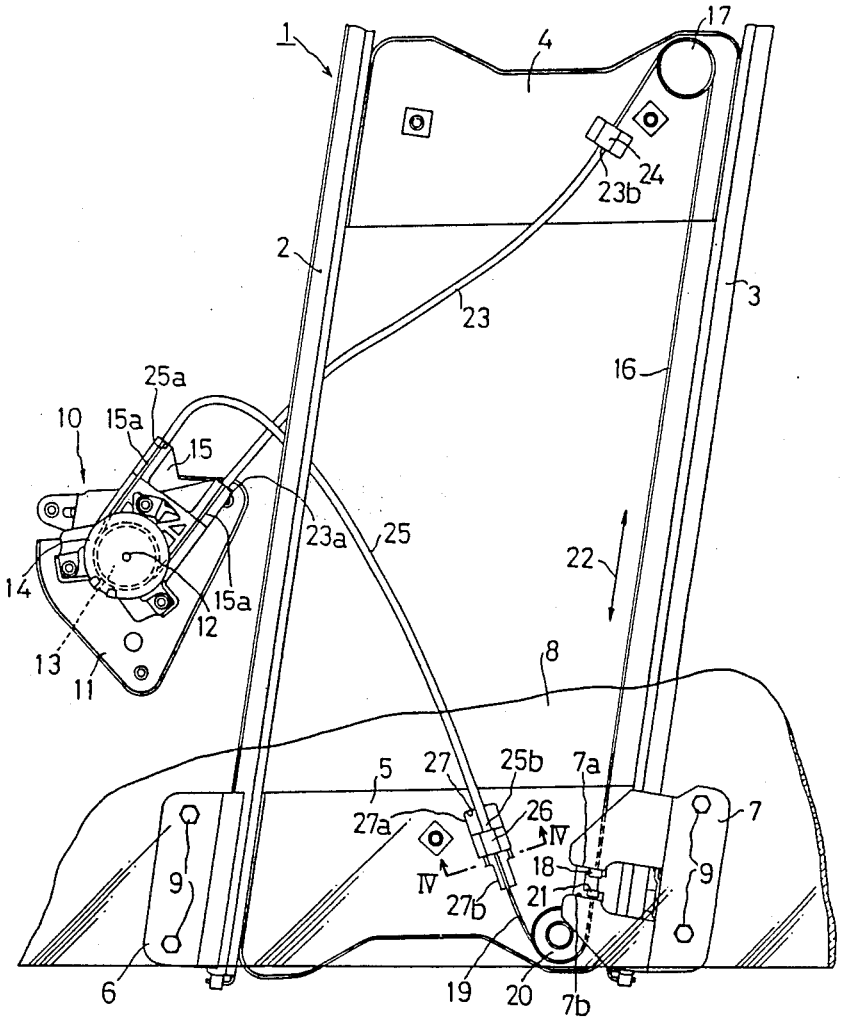
FIG. 1 is a front view showing a window regulator to which an embodiment of the present invention is applied.

Hereinafter the present invention will be described basing on an embodiment shown in the drawings.

The reference number (1) indicates a guide rail frame which is composed to a parallelogram with a pair of guide rails (2) and (3) which slightly incline in the upper right direction and a pair of supporting plates (4) and (5) provided on the upper end portion and the lower end portion of the pair of guide rails (2) and (3). These supporting plates (4) and (5) are secured to an inner panel (not shown) of a door of an automobile.

On the guide rail (2) of the left side through a suitable roller (not shown) a guide plate (6) for guiding is movably mounted, and a carrier plate (7) for up and down movements is, also through a suitable roller (not shown), mounted movably on the guide rail (3) of the right side. The reference number (8) indicates a window glass which is secured to the guide plate (6) and the carrier plate (7) with bolts (9) at the lower portion thereof, and can be moved up and down along the guide rails (2) and (3).

The reference number (10) indicates a driving means. To a base plate 11 of the driving means (10) secured to the inner panel of the door (not shown) a case (14) in which a winding drum (13) secured to an axis (12) of rotation which is inversibly rotated by an operating handle (not shown) is accommodated is attached. A guide member (15) on which a pair of parallel guiding grooves (15*a*) and (15*a*) are bored is provided adjacent to the case (14).

The reference number (16) is a raising wire, and one end of the raising wire (16) is wound on the winding drum (13) and then secured to the outer circumference of the winding drum (13). The other end of the raising wire (16) extends from the right side guiding groove (15*a*) to wind a guide pulley (17) pivotally mounted on the support plate (4), and after winding up the guide pulley (17) it lowers along the guide rail (3) in an overturned U character shape to be engagingly secured by its end member (18) to a slit (not shown) provided on an upper edge (7*a*) of the central opening part of the carrier plate (7). Thus, the other end of the raising wire (16) is secured to the carrier plate (7).

One end of the lowering wire (19) is wound on the winding drum (13) in the inverse direction to that of the end of the raising wire (16) and secured to the outer circumference of the winding drum (13). The other end thereof runs from the left side guiding groove (15*a*), and lowers in circular arc to wind a guide pulley (20) pivotally mounted on the supporting plate (5), and after then the end is secured to the carrier plate (7) by engagedly fixed its end member (21) to a slit (not shown) which is provided at the lower edge portion (7*b*) of the central opening part of the carrier plate (7).

As described the above, when the winding drum (13) is rotated in the clockwise direction (in FIG. 1) by the operating handle of the driving means (10), the window glass (8) raises up, and opposite thereto when the winding drum (13) is rotated in the counterclockwise direction (in FIG. 1), the window glass (8) lowers down.

Next, descriptions with respect to a method and a means for eliminating the initial loosened conditions of the above described wires (16) and (19) which reciprocally move along a closed loop configured circular passage (22).

The reference number (23) indicates an outer tube made of rigid synthetic resin material having elasticity which covers an intermediate portion of the raising wire (16). An end surface (23*a*) of the outer tube (23) of the basic end contacts with the guide member material, and to the other end thereof the tube end plug (24) which is fitted to the outer circumference (23*b*) of the outer tube (23) is secured. By pressing the afore-mentioned tube end plug (24) slightly so that the outer tube (23) may form somewhat arc-shaped curve, and the tube end plug (24) is secured to the supporting plate (4) through the tube end plug (24) disposed at a predetermined position so that the wire (16) is appropriately stretched. As same as the afore-mentioned, an end surface (25*a*) of the basic side of an outer tube (25) of the lowering wire (19) contacts with the guide member (15), and at the outer circumference (25*b*) of the other end of the outer tube (25) a tube end plug (26) is connected with the outer tube (25) which covers an intermediate portion of the lowering wire (19).

Figure 3A:
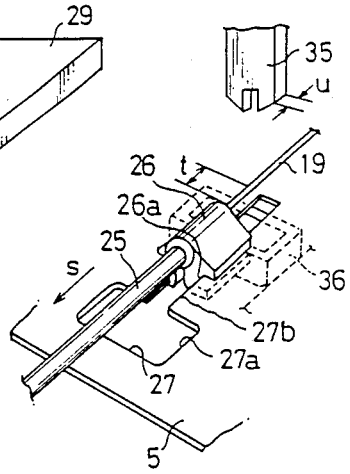
FIG. 3*a* is a perspective view showing the fitting jig shown in FIG. 2 being used.
Figure 3B:
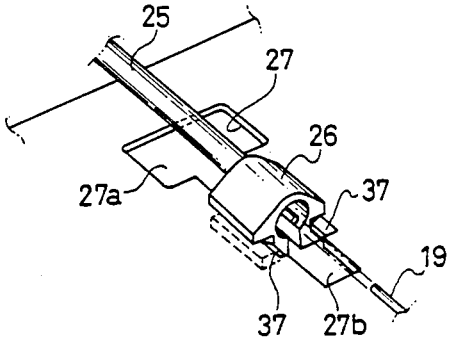
FIG. 3*b* is a perspective view showing a state in which a tube end plug and narrow hole are being coupled.
Figure 5:
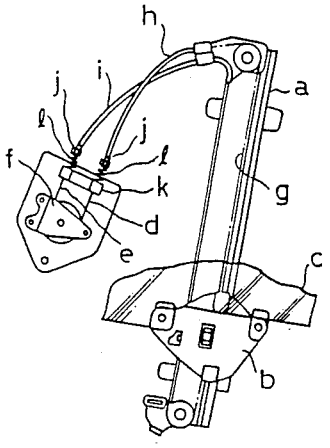
FIG. 5 PRIOR ART
FIG. 5 is a front view of a window regulator to which the conventional method is applied.
Figure 6:
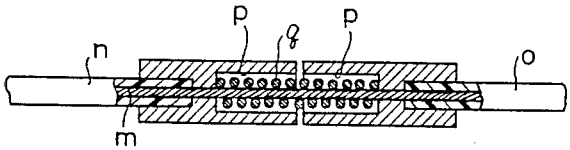
FIG. 6 PRIOR ART
FIG. 6 is a longitudinal sectional view of an expanding means of a window regulator other than shown in FIG. 5.

As shown in FIG. 3, the tube end plug (26) has grooves (26*a*) at both sides of the lower part of the tube end plug each of which section is a rectangle, and on the supporting plate (5) which corresponds to the tube end plug (26), there is provided a guide hole (27) having an inserting hole (27*a*) of any shape (in the embodiment the hole (27) has a rectangular shaped hole (27*a*)) and a narrow hole (27*b*) which is situated at the central part of the lower side (right hand side in FIG. 3) of the inserting hole (27*a*) (it is preferable for the guide hole to have a T shape). After the lower end portion is inserted into the rectangular hole (27*a*), the tube end plug (26) is moved so that each of edges of the narrow hole (27*b*) may be slidably fitted in the respective grooves (26*a*). At the central portion of the bottom of the tube end plug (26) a groove (26*c*) into which the lowering wire (19) is to be penetrated is bored, and the tube end plug (26) is movably supported in the tensioned direction of the lowering wire (19).

Figure 2:
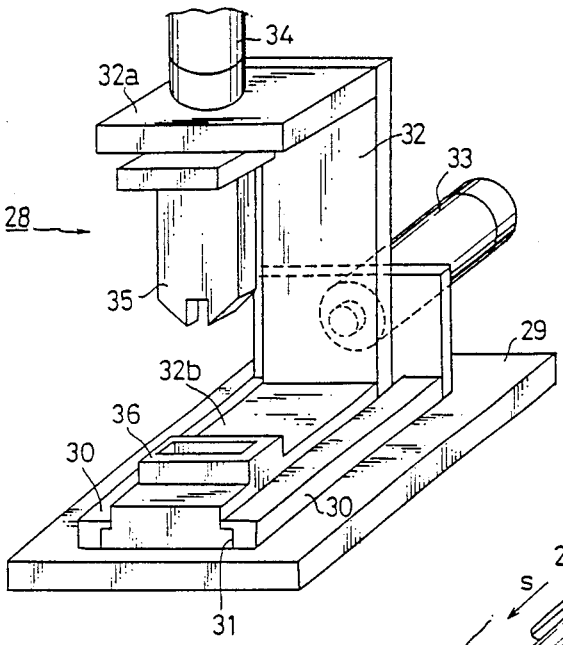
FIG. 2 is a perspective view of a fitting jig used for practising the present invention.

In FIG. 2 there is shown a jig (28) for fitting the tube end plug (26) with the outer tube (25) of the lowering wire (19). A reciprocally movable stand (32) having a form of the front portion thereof being opened (that is, shape) is moved in the front and rear direction by an air cylinder (33) by being guided by a pair of guide grooves (31) formed with a pair of guiding pieces (30) on a base plate (29). On an upper horizontal plate (32*a*) of the reciprocally movable stand (32) there is fitted up an air cylinder (34) which directs downwards. To a piston rod which vertically penetrates the horizontal plate (32*a*) downwards a punch (35) having biforked and inclined cutting edge is provided, and on a bottom plate (32*b*) of the reciprocally movable stand (32) which opposes to the punch (35) there is provided a tubular die (36) having a rectangular opening on the upper surface.

In order to secure the wires (16) and (19) on their tensioned conditions the afore-mentioned fitting jig (28) is disposed so that it may be met with the tube end plug (26), and as shown in FIG. 3, in the stretching direction of the lowering wire (19), that is, in the direction of the driving means (10) shown by an arrow mark (s), the reciprocally movable stand (32) is advanced, and thus at the upper end surface of the die (36) the lower end surface of the tube end plug (26) is pressed.

From an original position at which the tube end plug (26) remains stationary within the narrow hole (27*b*) the tube end plug (26) is pushed by a predetermined distance (t), and in a state of the outer tube (25) being elastically deformed so that the whole length of the outer tube (25) may be curved as an arc, by moving down the punch (35) to cut the edge of the opening of the narrow hole (27*b*) at two portions with a width (u) same as that of the punch (35) and by directing the cut portions (hereinafter, refer cut pieces) downwards, movement of the tube end plug (26) is interrupted. In the above the cut piece is a piece of which at least one part thereof is not separated from the edge, but any projecting portion which projects from the edge from the opening of said guide may also well do.

Figure 4:
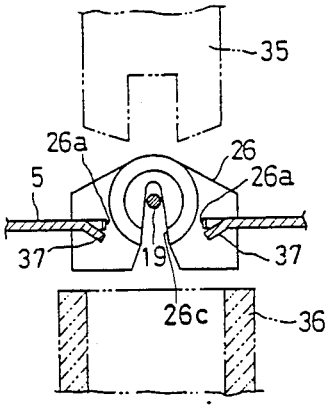
FIG. 4 is a longitudinal sectional view cut along IV—IV line in FIG. 1.

In the case of the wires having been secured and the fitting jig (28) having been removed, as shown imaginary lines in FIG. 4, even if the tube end plug (26) tried to return to the original position, as the cut pieces (37) serve as stoppers, the lowering wire (19) is in a state at which tensioning force same as that of the initial state is applied. By means of this tensioning force, even if permanent elongations of the wires occur in the circular passage (22) composed of the raising wire (16) and the lowering wire (19), the elongation can be absorbed by variation in curvature of the arc-shaped outer tube (25). Accordingly, no slack can be generated, which results in assuring smooth up and down movements of the window glass(es).

In the above-described embodiment the wire is secured in its stretched or tensioned condition by pressing the tube end plug of the lowering wire in the guide hole bored on the lower supporting plate on which the outer tube end plug is provided, however, of course, instead of pressing the wire as the afore-mentioned, it is also possible to secure the wire by pressing the outer tube end plug of the outer tube for the raising wire in the guide hole which is bored on the upper supporting plate on which the tube end plug is provided.

In addition, contrary to the above-described embodiment, a cut piece may be turned upward (in FIG. 4 there is shown the cut piece (37) being turned downward). In this case the cut piece is adapted to contact with substantially the central portion of the end surface of the tube end plug, so that when the wire is stretchedly secured, no bending force exerts to the tube end plug, which results in distorting the tube end plug.

As described in detail heretofore, according to the present invention, it is possible to secure the wire stretchedly with only a simple work, that is, by curving the outer tube of the wire, then a part of an edge of the opening of the guide hole is cut to erect it without one part thereof not being cut away. Thus, improvement in workability of assembling can be highly expected. In addition, without using any compressing spring or the like which are indispensably necessary for the conventional constructions, which results in realizing light weight thereof by reducing the number of parts or members.

Further, an error in length of the wire generated in the case of the window regulator being assembled can be also absorbed by changing the position of the cut piece. In addition, in the present invention there is a further advantage to be able to obtain a constant wire tension.

What is claimed are:

1. A method for securing a wire stretchedly in a wire driving type window regulator in which a window glass is secured to a carrier plate which is mounted on a guide rail so as to do up and down movements along said guide rail, a raising wire and a lowering wire each of which one end terminals is secured to said carrier plate and each of intermediate portions of which is inserted into respective outer tubes are reciprocally moved by and tensioned toward a driving means along a passage one part of which runs along said guide rail, one end of each outer tube abutting a guide member on said driving means, and thus the carrier plate and the window glass are moved to up and down directions, characterized by comprising steps of:

boring an elongated guide hole on a member supporting the guide rail;

inserting slidably a tube end plug mounted on a wire and against the other end of said outer tube into interengagement with side edges of said guide hole;

pressing said tube end plug in the tensioned direction of said wire along said side edges of said hole with one end thereof against the other end of said tube so that said outer tube may form a slight arc-shaped curve; and providing a projecting portion projected from an edge of an opening of said guide hole without being separated therefrom against the other end of said tube end plug so as to maintain said arc-shaped curve in said tensioned condition of the wire.

2. An apparatus for securing a wire stretchedly in a wire driving type window regulator in which a window glass is secured to a carrier plate which is mounted on a guide rail so as to do up and down movements along said guide rail, a raising wire and a lowering wire each of which one end terminals is secured to said carrier plate and each of intermediate portions of which is inserted into respective outer tubes are reciprocally moved by and tensioned toward a driving means along a passage one part of which runs along said guide rail, one end of each outer tube abutting a guide member on said driving means, and thus the carrier plate and the window glass are moved up and down directions, characterized in that:

a guide hole bored on a supporting member secured to said guide rail so as to form a narrow hole elongating in the tensioned direction of said wire and an inserting hole which is successively connected with said narrow hole;

an end tube plug having a groove on each side of the lower portion thereof for engaging slidingly movable in the tensioned direction of said wire with respective edges of said narrow hole through said inserting hole is provided on one end of said outer tube; and a projecting portion projected from an edge of an opening of said guide hole playing a role for a stopper which is engageable with the other end of said tube end plug, while said tube end plug is pressed in the tensioned direction of said wire so that said outer tube is maintained in a slight arc-shaped curve is formed on said narrow hole of said guide hole.

3. An apparatus according to claim 2, wherein said inserting hole is a rectangular shape.

4. An apparatus according to claim 2, wherein said guide hole has a T shape.

* * * * *